US009389026B2

(12) United States Patent
Hwang et al.

(10) Patent No.: US 9,389,026 B2
(45) Date of Patent: Jul. 12, 2016

(54) HEAT EXCHANGER

(71) Applicant: LG ELECTRONICS INC., Seoul (KR)

(72) Inventors: Junhyeon Hwang, Changwon-si (KR); Hongseok Choi, Changwon-si (KR); Changhwan Cho, Changwon-si (KR)

(73) Assignee: LG ELECTRONICS INC., Seoul (KR)

( * ) Notice: Subject to any disclaimer, the term of this patent is extended or adjusted under 35 U.S.C. 154(b) by 391 days.

(21) Appl. No.: 13/890,405

(22) Filed: May 9, 2013

(65) Prior Publication Data

US 2014/0014305 A1 Jan. 16, 2014

(30) Foreign Application Priority Data

Jul. 11, 2012 (KR) ..... 10-2012-0075636

(51) Int. Cl.
*F28F 1/00* (2006.01)
*F28D 7/02* (2006.01)
*F28F 9/26* (2006.01)

(52) U.S. Cl.
CPC . *F28F 1/00* (2013.01); *F28D 7/024* (2013.01); *F28F 9/26* (2013.01)

(58) Field of Classification Search
CPC ..... F28D 7/024; F28D 7/04; F28D 7/10; F28F 1/00; F28F 9/26; F28F 2280/06
USPC ..... 165/140, 144, 145, 163
See application file for complete search history.

(56) References Cited

U.S. PATENT DOCUMENTS 1,526,320 A * 2/1925 Cook ..... F28D 7/024 165/113
1,840,940 A * 1/1932 Ecabert ..... F25B 39/04 165/161

(Continued)

FOREIGN PATENT DOCUMENTS

DE 1 078 145 3/1960
DE 1078145 B * 3/1960 ..... F28D 7/024

(Continued)

OTHER PUBLICATIONS

European Search Report dated Sep. 24, 2013.

(Continued)

*Primary Examiner* — Tho V Duong
(74) *Attorney, Agent, or Firm* — Ked & Associates LLP

(57) ABSTRACT

A heat exchanger is provided. The heat exchanger may include a shell; a first pipe that guides a first fluid into the shell; a plurality of spiral pipe portions, through which a second fluid, which exchanges heat with the first fluid, may pass, that have different distances from a central axis; and a second pipe that guides the first fluid outside of the shell, in which an inner spiral pipe portion of the plurality of spiral pipe portions, which is closest to a central axis, and an outer spiral pipe portion, which is farthest from the central axis, are connected by a first connection tube, and a plurality of intermediate spiral pipes, which is farther from the central axis than the inner spiral pipe portion and closer to the central axis than the outer spiral pipe portion, is connected by a second connection tube, such that the plurality of spiral pipe portions is connected while minimizing a number of connection tubes and a reduction in performance that may be generated when a difference in length of a plurality of paths is large, by minimizing a difference in length of the paths formed by the plurality of spiral pipe portions and the connection tubes.

22 Claims, 9 Drawing Sheets

(56) References Cited

U.S. PATENT DOCUMENTS

| | | | | | |
|---|---|---|---|---|---|
| 1,940,964 | A | | 12/1933 | McIntyre | |
| 2,125,972 | A | | 8/1938 | Wilson | |
| 2,534,690 | A | | 12/1950 | Young, Jr. | |
| 2,566,976 | A | * | 9/1951 | Bernstrom | F24D 3/087 122/15.1 |
| 2,761,430 | A | | 9/1956 | Schaefer | |
| 2,805,048 | A | * | 9/1957 | Angelery | F24D 1/005 116/DIG. 22 |
| 2,888,251 | A | * | 5/1959 | Dalin | F28D 7/02 165/109.1 |
| 3,199,583 | A | | 8/1965 | Hood, Jr. et al. | |
| 3,341,122 | A | | 9/1967 | Whittell, Jr. | |
| 3,817,688 | A | | 6/1974 | Shadley | |
| 4,152,015 | A | | 5/1979 | Jones et al. | |
| 4,202,406 | A | | 5/1980 | Avery | |
| 4,313,491 | A | * | 2/1982 | Molitor | F28D 7/024 165/160 |
| 4,471,836 | A | | 9/1984 | Hokanson | 165/111 |
| 4,893,672 | A | * | 1/1990 | Bader | F28D 7/024 165/163 |
| 6,095,240 | A | | 8/2000 | Hassanein et al. | |
| 7,458,222 | B2 | | 12/2008 | Orr | |
| 7,549,462 | B2 | | 6/2009 | Nuris et al. | |
| 2006/0005955 | A1 | | 1/2006 | Orr | |
| 2009/0025399 | A1 | | 1/2009 | Kamen | |

FOREIGN PATENT DOCUMENTS

| | | | |
|---|---|---|---|
| DE | 1 952 861 | | 4/1971 |
| DE | 1 679 733 | | 1/1972 |
| DE | 8715522 | U1 | 5/1988 |
| DE | 10 2007 002 051 | | 7/2007 |
| EP | 0 261 005 | | 3/1988 |
| EP | 0 819 892 | A2 | 1/1998 |
| EP | 0 845 640 | | 6/1998 |
| EP | 0 845 640 | A1 | 6/1998 |
| EP | 1 750 070 | | 2/2007 |
| EP | 1 813 882 | | 8/2007 |
| EP | 2 505 932 | A1 | 10/2012 |
| GB | 152276 | A | 10/1920 |
| GB | 811665 | A | 4/1959 |
| GB | 1387571 | A | 3/1975 |
| JP | 6-84167 | | 12/1994 |
| JP | 2000-055574 | | 2/2000 |
| JP | 2002-195767 | | 7/2002 |
| JP | 2004-144366 | A | 5/2004 |
| JP | 2007-278688 | A | 10/2007 |
| JP | 2007-333319 | A | 12/2007 |
| JP | 2012-072936 | | 4/2012 |
| KR | 10-1999-0076959 | A | 10/1999 |
| KR | 10-2001-0029372 | A | 4/2001 |
| KR | 10-0353334 | | 2/2003 |
| KR | 10-2004-0111678 | A | 12/2004 |
| KR | 10-2007-0094792 | A | 9/2007 |
| KR | 10-2009-0095253 | | 9/2009 |
| KR | 10-2011-0088913 | A | 8/2011 |
| KR | 10-2011-0128709 | | 11/2011 |
| WO | WO 88/01362 | | 2/1988 |
| WO | WO 03/023306 | | 3/2003 |
| WO | WO 03/087677 | | 10/2003 |
| WO | WO 2006/105605 | A1 | 10/2006 |

OTHER PUBLICATIONS

Korean Office Action dated Aug. 30, 2013.
European Search Report dated Nov. 21, 2014. (Full English Text).
Korean Office Action dated Dec. 26, 2014.
European Search Report dated Dec. 11, 2014. (Full English Text).
European Search Report dated May 13, 2014 issued in Application No. 14 151 438.0.
European Search Report dated May 13, 2014 issued in Application No. 13 193 106.5.
Korean Office Action dated May 30, 2014 issued in Application No. 10-2013-0011836.
Korean Office Action dated May 30, 2014 issued in Application No. 10-2013-0011837.
Korean Office Action dated May 30, 2014 issued in Application No. 10-2013-0011838.
Korean Office Action dated May 30, 2014 issued in Application No. 10-2013-0011839.
U.S. Notice of Allowance dated Oct. 7, 2015 issued in co-pending U.S. Appl. No. 13/887,728.
U.S. Office Action dated Jun. 4, 2015 issued in co-pending U.S. Appl. No. 13/895,542.
U.S. Office Action dated Jun. 12, 2015 issued in co-pending U.S. Appl. No. 13/887,728.
Korean Office Action dated Mar. 10, 2016 issued in Application No. 10-2012-0068752.

* cited by examiner

HEAT EXCHANGER

CROSS-REFERENCE TO RELATED APPLICATION(S)

This application claims priority under 35 U.S.C. §119 to Korean Application No. 10-2012-0075636, filed in Korea on Jul. 11, 2012, the entire disclosure of which is hereby incorporated by reference.

BACKGROUND

1. Field

A heat exchanger is disclosed herein.

2. Background

Heat exchangers are known. However, they suffer from various disadvantages.

BRIEF DESCRIPTION OF THE DRAWINGS

Embodiments will be described in detail with reference to the following drawings in which like reference numerals refer to like elements, wherein.

DETAILED DESCRIPTION

Heat exchangers are apparatuses that allow heat to transfer between two fluids and that are used for various purposes, such as cooling, heating, and supplying hot water. Heat exchangers may function as a waste heat recovery heat exchanger that recovers waste heat, a cooler that cools fluid at a high-temperature side, a heater that heats fluid at a low-temperature side, a condenser that condenses vapor, or an evaporator that evaporates fluid at a low-temperature side.

Various kinds of heat exchangers may be used, such as a fin-tube type heat exchanger having a tube, through which a first fluid flows, and fins formed on the tube; a shell-tube type air conditioner having a shell, through which a first fluid flows, and a tube, through which a second fluid that exchanges heat with the first fluid flows; a double tube type heat exchanger having an inner tube, through which a first fluid flows, and an outer tube, through which a second fluid that exchanges heat with the first fluid flows, that covers the inner tube; and a plate type heat exchanger, in which a first fluid and a second fluid flow with a heat transfer plate therebetween.

A tube of the shell-tube type heat exchanger may be spirally formed, and the spiral tube may allow heat exchange between first fluid and second fluid in the shell. The first fluid may be discharged outside of the shell after flowing into the shell, and the second fluid may pass through the spiral tube. The second fluid may exchange heat with the first fluid while passing through the spiral tube.

Figure 1:
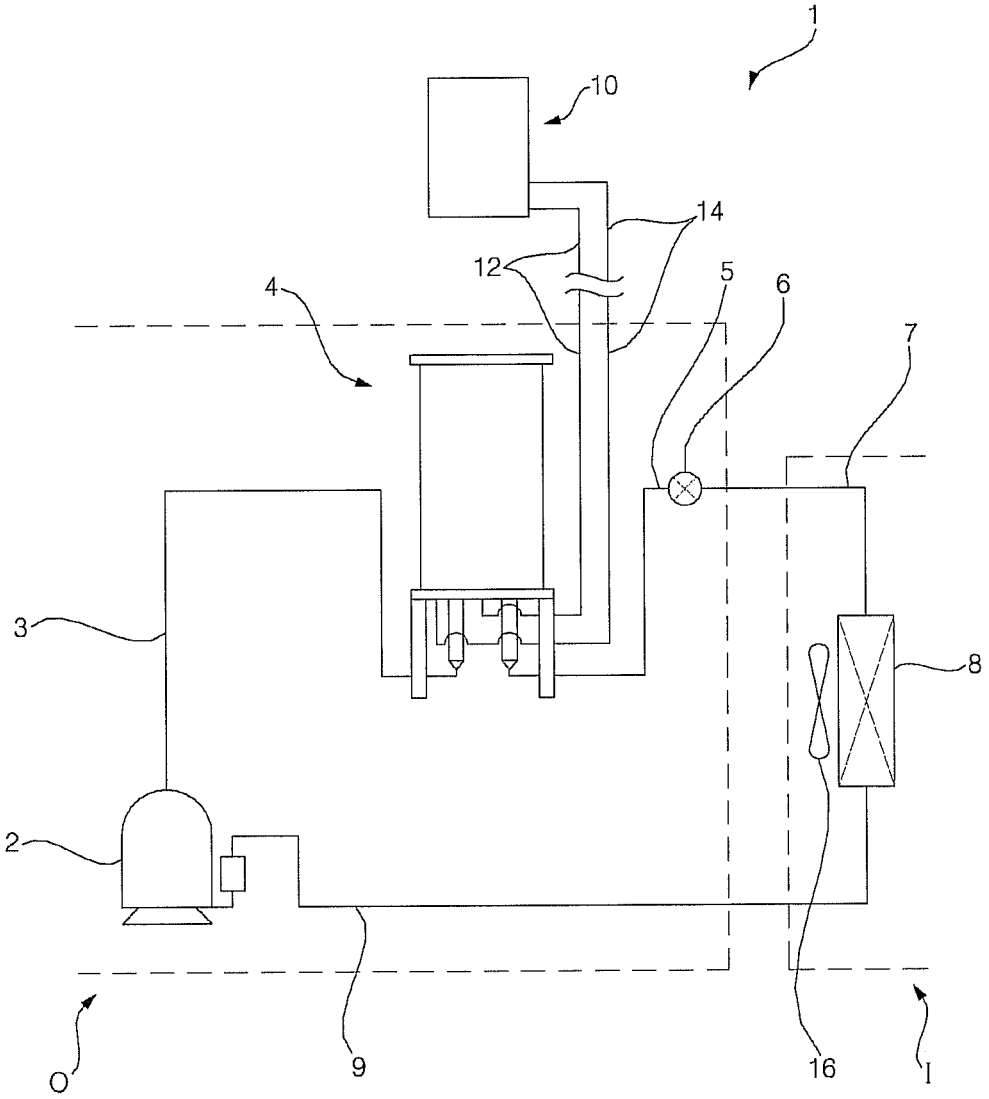
FIG. 1 is a schematic diagram of an air conditioner equipped with a heat exchanger according to an embodiment.

FIG. 1 is a schematic diagram of an air conditioner equipped with a heat exchanger according to an embodiment. The air conditioner 1 of FIG. 1 may include a compressor 2, a first heat exchanger 4, an expansion device 6, and a second heat exchanger 8. The first heat exchanger 4 may allow heat exchange between a first fluid and a second fluid. The first fluid may function as a cooling fluid that absorbs heat of the second fluid or a heating fluid that transfers heat to the second fluid. The air conditioner 1 may include the compressor 2, which compresses the second fluid; the first heat exchanger 4, through which the second fluid exchanges heat with the first fluid; the expansion device 6, which expands the second fluid; and the second heat exchanger 8, through which the second fluid exchanges heat with air.

The second fluid may sequentially passes through the compressor 2, the first heat exchanger 4, the expansion device 6, and the second heat exchanger 8. That is, the second fluid compressed by the compressor 2 may return to the compressor 2 after sequentially passing through the first heat exchanger 4, the expansion device 6, and the second heat exchanger 8. In this process, the first heat exchanger 4 may function as a condenser that condenses the second fluid, the second heat exchanger 8 may function as an evaporator that evaporates the second fluid, and the first fluid may function as a cooling fluid that absorbs the heat of the second fluid compressed by the compressor 2.

Alternatively, the second fluid may sequentially passes through the compressor 2, the second heat exchanger 8, the expansion device 6, and the first heat exchanger 4. That is, the second fluid compressed by the compressor 2 may return to the compressor 2 after sequentially passing through the second heat exchanger 8, the expansion device 6, and the first heat exchanger 4. In this process, the second heat exchanger 8 may function as a condenser that condenses the second fluid, the first heat exchanger 4 may function as an evaporator that evaporates the second fluid, and the first fluid may function as a heating fluid that transfers heat to the second fluid passing through the first heat exchanger 4.

The air conditioner 1 may further include a flow path selector (not shown), such as a valve, that allows the second fluid compressed by the compressor 2 to flow to the first heat exchanger 4 or the second heat exchanger 8. The air conditioner 1 may include a first circuit through which the second fluid compressed by the compressor 2 returns to the compressor 2 after sequentially passing through the flow path selector, the first heat exchanger 4, the expansion device 6, the second heat exchanger 8, and the flow path selector. The air conditioner 1 may include a second circuit through which the second fluid compressed by the compressor 2 returns to the compressor 2 after sequentially passing through the flow path selector, the second heat exchanger 8, the expansion device 6, the first heat exchanger 4, and the flow path selector. The first circuit may be a circuit for a cooling operation by which a room may be cooled by the second heat exchanger 8, the first heat exchanger 4 may function as a condenser that condenses the second fluid, and the second heat exchanger 8 may function as an evaporator that evaporates the second fluid. The second circuit may be a circuit for a heating operation by which a room may be heated by the second heat exchanger 8, the second heat exchanger 8 may function as a condenser that condenses the second fluid, and the first heat exchanger 4 may function as an evaporator that evaporates the second fluid.

The first fluid may be liquid-state fluid, such as water or antifreeze, and the second fluid may be various kinds of refrigerants, such as a Freon-based refrigerant or a carbon dioxide refrigerant generally used for air conditioners.

The compressor 2 may be a compressor that compresses the second fluid. The compressor may be various compressors, such as a rotary compressor, a scroll compressor, or a screw compressor. The compressor 2 may be connected with the first heat exchanger 4 by a compressor outlet channel 3.

The first heat exchanger 4 may be a shell-tube type heat exchanger. The first heat exchanger 4 may include a shell, through which the first fluid may pass, and a tube, through which the second fluid may pass. The first heat exchanger 4 may be connected with the expansion device 6 by a first heat exchanger-expansion device connection channel 5. The first heat exchanger 4 will be described in detail hereinbelow.

The expansion device 6 may be a capillary tube or an electronic expansion valve through which the second fluid may expand. The expansion device 6 may be connected with the second heat exchanger 8 by an expansion device-second heat exchanger connection channel 7.

The second heat exchanger 8 may be a fin-tube type heat exchanger or a coil type heat exchanger through which the second fluid may pass. The second heat exchanger 8 may include a tube, through which the second fluid may exchange heat with indoor air. The second heat exchanger 8 may further include fins, which function as heat transfer members, coupled to the tube. The second heat exchanger 8 may be connected with the compressor 2 by a compressor intake channel 9.

The air conditioner 1 may further include a heat treatment device 10 connected with the first heat exchanger 4. The heat treatment device 10 may function as a cooler that cools the first fluid, when the first heat exchanger 4 functions as a condenser that condenses the second fluid. Alternatively, the heat treatment device 10 may function as a heater that heats the first fluid, when the first heat exchanger 4 functions as evaporator that evaporates the second fluid. When functioning as a cooler, the heat treatment device 10 may include a cooling tower that cools the first fluid. The first fluid may be a cooling fluid, such as water or antifreeze, and the heat treatment device 10 may be connected with the first heat exchanger 4 by water discharge pipe 12 and water intake pipe 14. The first heat exchanger 4 may be connected with the heat treatment device 10 through the water discharge pipe 12, and the first fluid in the first heat exchanger 4 may be discharged to the heat treatment device 10 through the water discharge pipe 12. The first heat exchanger 4 may be connected with the heat treatment device 10 by the water intake pipe 14, and the first fluid in the heat treatment device 10 may enter the first heat exchanger 4 through the water intake pipe 14. A circulating mechanism, such as a pump, that circulates the first fluid to the heat treatment device 10, and the first heat exchanger 4, may be disposed in at least one of the heat treatment device 10, the water discharge pipe 12, or the water intake pipe 14.

The air conditioner 1 may further include an indoor fan 16 that returns indoor air to a room through the second heat exchanger 8.

The compressor 2, the first heat exchanger 4, the expansion device 6, the second heat exchanger 8, and the indoor fan 16 may constitute an air-conditioning device. Air in a room may cool or heat the room by flowing to the second heat exchanger 8 through, for example, a duct, and may then discharged to the room through, for example, a duct. The heat treatment device 10 may be disposed not in the air-conditioning device, but outside of the air-conditioning device and connected with the air-conditioning device through the water discharge pipe 12 and water intake pipe 14.

The compressor 2, the first heat exchanger 4, the expansion device 6, the second heat exchanger 8, and the indoor fan 16 may be distributed in a plurality of air-conditioning devices I and O. The first heat exchanger 4 and the indoor fan 16 may be disposed together in an indoor device I, and the compressor 2 and the first heat exchanger 4 may be disposed together in a compression device O (or outdoor device).

The expansion device 6 may be disposed in at least one of the indoor device I and the compression device O. For the expansion device 6, one expansion device may be disposed in the indoor device I or the compression device O. Alternatively, a plurality of expansion devices 6 may be provided. A first expansion device may be disposed in the indoor device I, and a second expansion device may be disposed in the compression device O. The first expansion device may function as an outdoor expansion device, which is disposed closer to the first heat exchanger 4 than the second heat exchanger 8. The second expansion device may function as an indoor expansion device, which is disposed closer to the second heat exchanger 8 than the first heat exchanger 4.

The indoor device I may be disposed in a room to cool or heat. A plurality of indoor devices I may be connected with the compression device O. The compression device O may be installed at or in, for example, a machine room, a basement, or a roof of a building. The compression device O may be connected with the heat treatment device 10 by the water discharge pipe 12 and water intake pipe 14.

Figure 2:
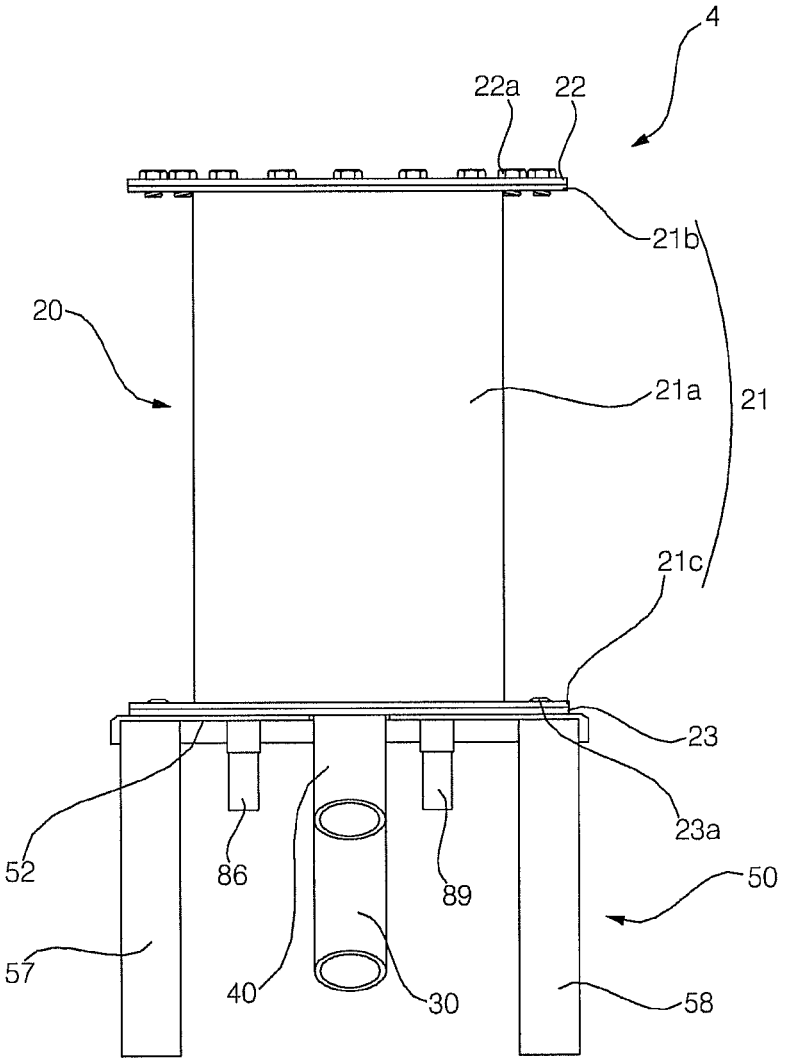
FIG. 2 is a side view showing an external appearance of a heat exchanger according to an embodiment.
Figure 3:
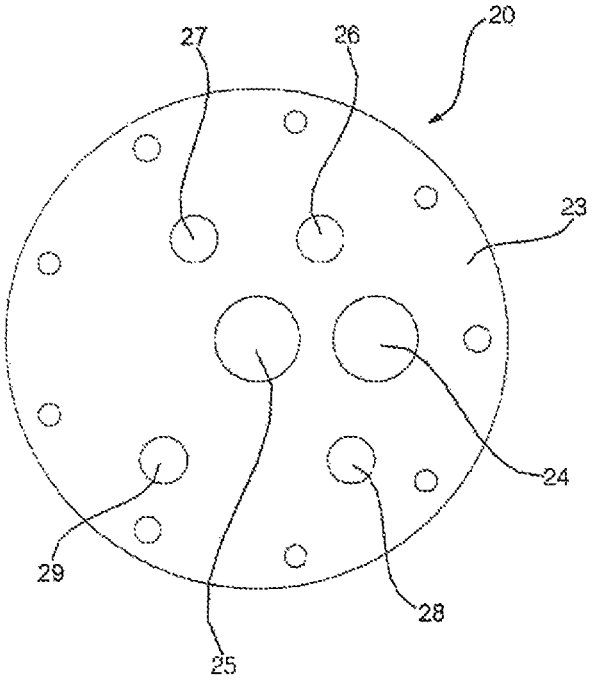
FIG. 3 is a bottom view of a shell of FIG. 2.
Figure 4:
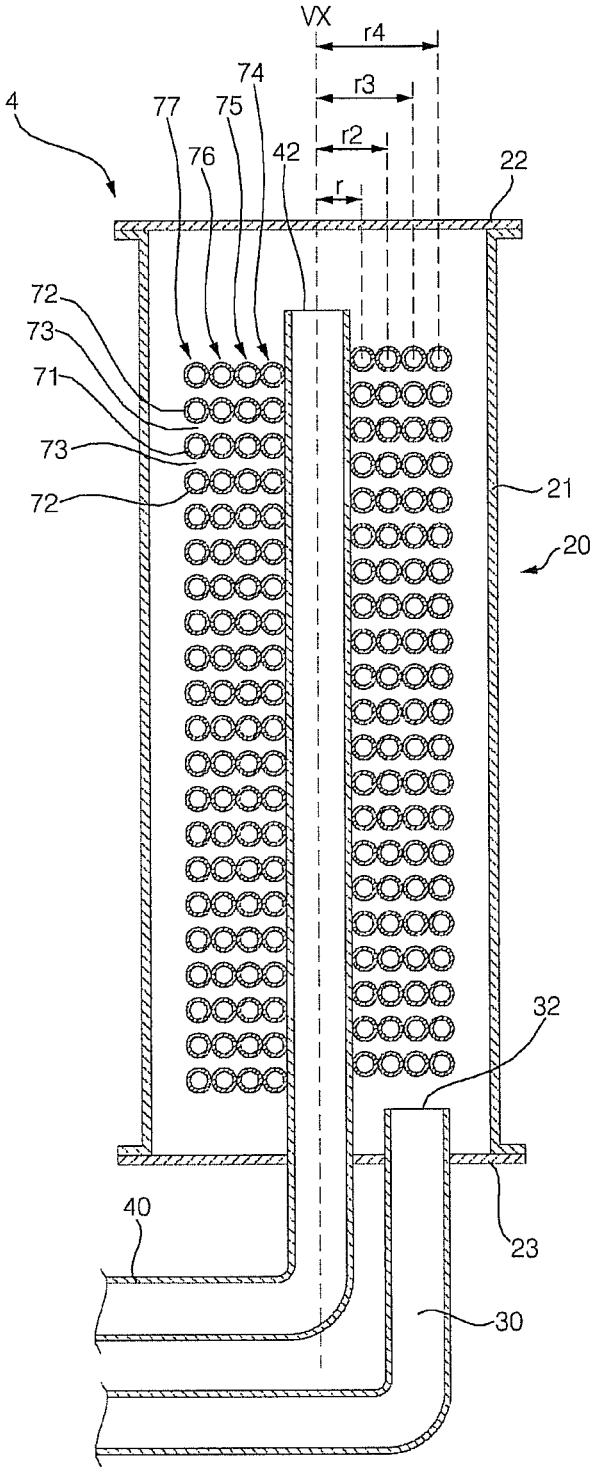
FIG. 4 is a cross-sectional view showing an inside of a heat exchanger according to an embodiment.
Figure 5:
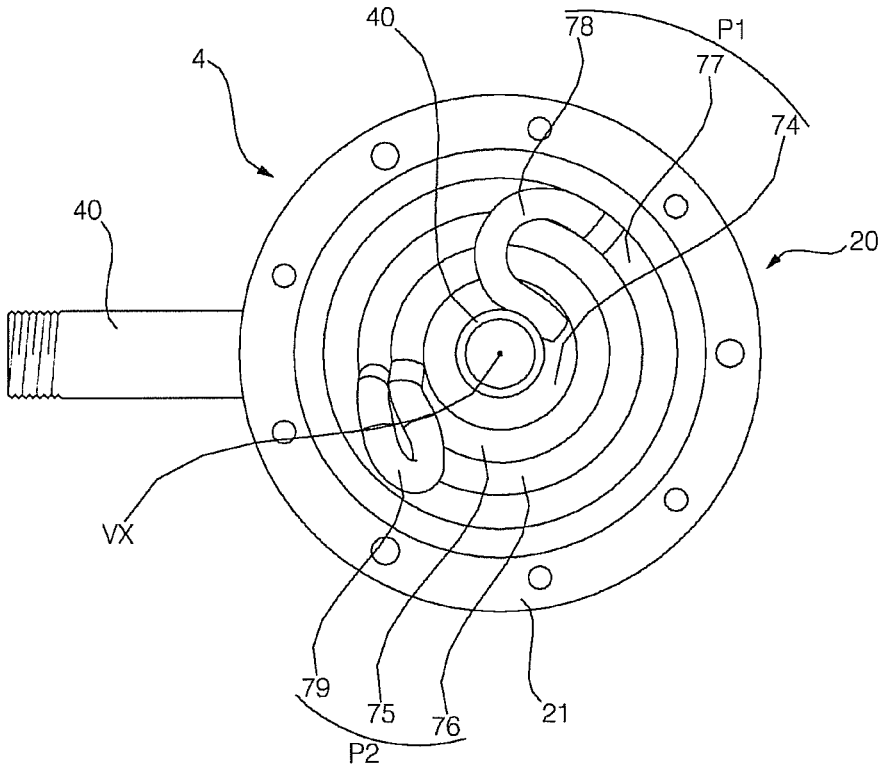
FIG. 5 is a plan view showing a plurality of spiral pipe portions of a heat exchanger according to an embodiment.
Figure 6:
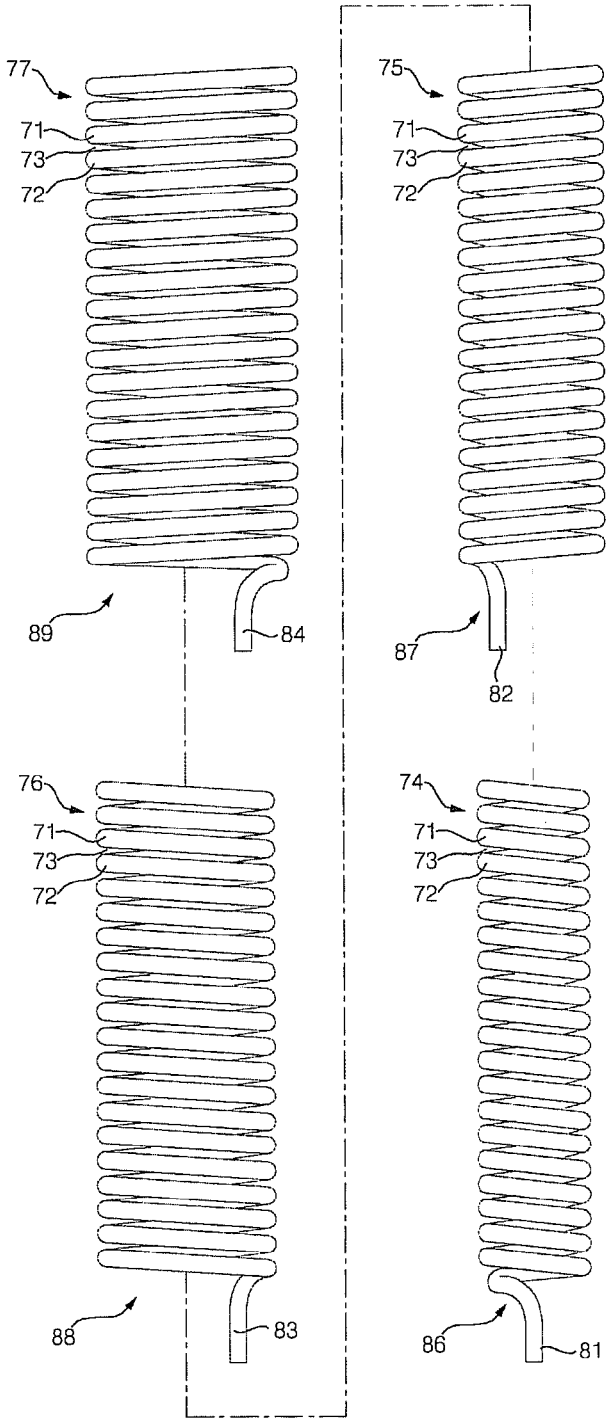
FIG. 6 is a side view showing spiral pipe portions of a heat exchanger according to an embodiment, separated.

FIG. 2 is a side view showing an external appearance of a heat exchanger according to an embodiment. FIG. 3 is a bottom view of a shell of FIG. 2. FIG. 4 is a cross-sectional view showing an inside of a heat exchanger according to an embodiment. FIG. 5 is a plan view showing a plurality of spiral pipe portions of a heat exchanger according to an embodiment. FIG. 6 is a side view showing spiral pipe portions of a heat exchanger according to an embodiment, separated.

The heat exchanger 4 may include a shell 20, a first pipe 30 that guides the first fluid into the shell 20, a second pipe 40, through which the first fluid may be guided outside of the shell 20, and a plurality of spiral pipe portions 74, 75, 76, and 77, through which the second fluid, which exchanges heat with the first fluid, may pass, and which is spirally wound and has different distances from a central axis VX.

The shell 20 may include a case 21 which is vertically disposed or extends vertically, a top cover 22 coupled to a top of the case 21, and a lower cover 23 coupled to a bottom of the case 21. The plurality of spiral pipe portions 74, 75, 76, and 77 may be disposed in the case 21, and a space through which the first fluid may flow may be formed. The case 21 may be manufactured separately from the upper cover 22 and the lower cover 23, and may then combined with the top cover 22 and the lower cover 23, without being integrally formed with at least one of the top cover 22 or the lower cover 23. When the case 21, the top cover 22, and the lower cover 23 are separately manufactured and then combined, an inner circumferential surface of the case 21, an underside of the top cover 22, and a top of the lower cover 23 may be easily coated with a coating fluid. When an inside of the shell 20 is coated, with the case 21 integrally formed with one of the top cover 22 or the lower cover 23, a coating fluid may not be uniformly spread throughout an inner wall of the case 21. In contrast, when the case 21, the top cover 22, and the lower cover 23 are separately manufactured, the coating fluid may be uniformly spread throughout the inner wall of the case 21. The case 21, the top cover 22, and the lower cover 23 may be combined in the shell 20, after the inner circumferential surface of the case 21, the underside of the top case 22, and the top of the lower cover 23 are coated.

The case 21 may have a hollow body 21*a* with a space 18 therein, a first connecting portion 21*b* to be coupled with the top cover 22, and a second connecting portion 21*c* to be coupled with the lower cover 23. The hollow body 21*a* may be formed in a hollow cylindrical shape. The first connecting portion 21*b* may protrude in a flange shape from an upper end of the hollow body 21*a*. The first connecting portion 21*b* may have fastening holes to fasten to the top cover 22 by fasteners 22*a*, such as bolts. The second connecting portion 21*c* may protrude in a flange shape from a lower end of the hollow body 21*a*. The second connecting portion 21*c* may have fastening holes to fasten to the lower cover 23 by fasteners 23*a*, such as bolts.

The top cover 22 may be a plate. That is, the top cover 22 may be formed in a circular plate shape. A fastening hole corresponding to the first connecting portion 21*b* may be formed through the top cover 22, and the top cover 22 may be coupled to the first connecting portion 21*b* by the fasteners 22*a*, such as bolts.

The lower cover 23 may be a plate. That is, the lower cover 23 may be formed in a circular plate shape. A fastening hole corresponding to the second connecting portion 21*b* may be formed through the lower cover 23, and the lower cover 23 may be coupled to the second connecting portion 21*c* by the fasteners 23*a*, such as bolts.

The first fluid may flow into the space 18 through the first pipe 30. The first fluid may exchange heat with the plurality of spiral pipe portions 74, 75, 76, and 77 while flowing through the space 18. The first fluid may be discharged outside of the space 18 through the second pipe 40.

A first pipe through-hole 24, through which the first pipe 30 may pass, may be formed in the shell 20. A second pipe through-hole 25, through which the second pipe 40 may pass, may be formed in the shell 20. A plurality of straight pipe portions 81, 82, 83, and 84 (see FIG. 6) that extend, respectively, from the plurality of spiral pipe portions 74, 75, 76, and 77 may pass through the shell 20. One straight pipe portion may extend from one spiral pipe portion, and one spiral pipe portion and one straight pipe portion may constitute one tube 86, 87, 88, and 89. The straight pipe portions 81, 82, 83, and 84 may pass through the shell 20 and may be fixed to the shell 20. Straight pipe portion-through holes 26, 27, 28, and 29, through which the straight pipe portions 81, 82, 83, and 84 may pass, may be formed at the shell 20. A same number of straight pipe portion-through holes 26, 27, 28, and 29 as the straight pipe portions 81, 82, 83, and 84 may be formed. The plurality of spiral pipe portions 74, 75, 76, and 78 may be positioned in the space 18, and the plurality of straight pipe portions 81, 82, 83, and 84 may pass through the straight pipe portion-through holes 26, 27, 28, and 29. The tubes 86, 87, 88, and 89 may be supported with respect to the shell 20 by the straight pipe portions 81, 82, 83, and 84 fixed to the shell 20.

The first pipe 30 may pass through the shell 20, such that an exit end 32 thereof, through which the first fluid comes out from the first pipe 30, may be positioned in the shell 20. The first fluid flowing into the shell 20 through the first pipe 30 may fill up from a lower portion of the shell 20. The first pipe 30 may be disposed such that the exit end 32, through which the first fluid comes out, may be positioned at or in the lower portion of the shell 20. The portion of the first pipe 30, which may be positioned outside of the shell 20, may be connected to the water intake pipe 14 shown in FIG. 1. The exit end 32 of the first pipe 30, through which the first fluid comes out, may face at least one of the plurality of spiral pipe portions 74, 75, 76, and 77. The exit end 32 of the first pipe 30, through which the first fluid comes out, may be positioned under at least one of the plurality of spiral pipe portions 74, 75, 76, and 77.

The second pipe 40 may pass through the shell 20, such that the inlet end 42, through which the first fluid enters the second pipe 40, may be positioned in the shell 20. The second pipe 40 may be disposed such that the first fluid at the lower portion in the shell 20 is not discharged through the second pipe 40, but rather, the first fluid at an upper portion in the shell 20 may be discharged through the second pipe 40. The second pipe 40 may be disposed such that the inlet end 42, into which the first fluid may flow, may be positioned at the upper portion in the shell 20. The portion of the second pipe 40, which is positioned outside of the shell 20, may be connected to the water discharge pipe 12 shown in FIG. 1.

The first pipe 30 and the second pipe 40 may be disposed through one of the case 21, the top cover 22, or the lower cover 23. The plurality of straight pipe portion 81, 82, 83, and 84 may be disposed through one of the case 21, the top cover 22, or the lower cover 23. When the first pipe 30, the second pipe 40, and the plurality of tubes 86, 87, 88, 89 are disposed through the lower cover 23, the heat exchanger 4 may be easily cleaned. The first pipe-through hole 24, the second pipe-through hole 25, and the straight pipe portion-through holes 26, 27, 28, and 29 may be formed at the lower cover 23. The top cover 22 may be separated from the case 21, and the case 21 may be separated from the lower cover 23, with the first pipe 30, the second pipe 40, and the tubes 86, 87, 88, and 89 fixed to the lower cover 23. A worker may easily clean the heat exchanger 4, with the top cover 2 and the case 21 separated, and the first pipe 30, the second pipe 40, and the straight pipe portions 81, 82, 83, and 84 fixed to the lower cover 23. Considering easiness of cleaning of the heat exchanger 4, the first pipe 30, the second pipe 40, and the plurality of straight pipe portions 81, 82, 83, and 84 may be disposed through the lower cover 23.

The heat exchanger 4 may include a base 50 that supports the shell 20. The base 50 may have a fastening portion 52 to which the shell 20 may be fastened, and a plurality of legs 57 and 58. The fastening portion 52 may be formed in a plate shape. The fastening portion 52 may be horizontally disposed under the shell 20. The shell 20 may be placed on the fastening portion 52 or fastened to the fastening portion 52 by the fasteners 23*a*, such as bolts. When the shell 20 is placed on the fastening portion 52, all of the first pipe 30, second pipe 40, and the plurality of straight pipe portions 81, 82, 83, and 84 may extend in the lower portion of the shell 20, and a portion of the first pipe 30, a portion of the second pipe 40, and a portion of each of the straight pipe portions 81, 82, 83, and 84 may be positioned under the fastening portion 52.

The plurality of spiral pipe portions 74, 75, 76, and 77 may be disposed with a central axis or central longitudinal axis VX vertically arranged. The central axis VX may coincide with a central axis or central longitudinal axis of the second pipe 40. The plurality of spiral pipe portions 74, 75, 76, and 77 may have different distances r, r2, r3, and r4 in a direction extending perpendicular to the central axis VX. The plurality of spiral pipe portions 74, 75, 76, and 77 may be positioned between the second pipe 40 and the shell 20. For each of the plurality of spiral pipe portions 74, 75, 76, and 77, a plurality of turns 71 and 72 that vertically continue may constitute one spiral pipe portion. For each of the plurality of spiral pipe portions 74, 75, 76, and 77, a plurality of turns 71 and 72 that have the same distance from the central axis VX may be continuously and spirally wound. For each of the plurality of spiral pipe portions 74, 75, 76, and 77, a gap 73, through which the first fluid may pass, may be defined between adjacent turns 71 and 72. Each of the plurality of spiral pipe portions 74, 75, 76, and 77 may have at least ten or more turns. The spiral turns 71 and 72 may be wound continuously and spiral clockwise or counterclockwise. The turns 71 and 72 may be vertically spaced from each other, and the gap 73 may be defined between the turns 71 and 72. The first fluid may flow through spaces in the plurality of spiral pipe portions 74, 75, 76, and 77 through the gap 73, or may flow between the shell 20 and the plurality of spiral pipe portions 74, 75, 76, and 77 through the gap 73 from the spaces in the plurality of spiral pipe portions 74, 75, 76, and 77. The plurality of straight pipe portions 81, 82, 83, and 84 may be bent at a lowermost turn of the plurality of spiral pipe portions 74, 75, 76, and 77. The plurality of straight pipe portions 81, 82, 83, and 84 may be disposed to extend parallel to the central axis VX.

The plurality of spiral pipe portions 74, 75, 76, and 77 may include an inner spiral pipe portion 74, which is closest to the central axis VX, and an outer spiral pipe portion 77, which is farthest from the central axis VX. The inner spiral pipe portion 74 may be in contact with the second pipe 40. The inner spiral pipe portion 74 may be fixed to the second pipe 40. The outer spiral pipe portion 77 may be spaced from an inner wall of the shell 20. The inner spiral pipe portion 74 and the outer spiral pipe portion 77 may be connected by a first connection tube 78. The inner spiral pipe portion 74, the first connection tube 78, and the outer spiral pipe portion 77 may be connected in series, such that the second fluid, that is, the refrigerant, may sequentially pass through them. The second fluid may sequentially pass through the inner spiral pipe portion 74, the first connection tube 78, and the outer spiral pipe portion 77, and may sequentially pass through the outer spiral pipe portion 77, the first connection tube 78, and the inner spiral pipe portion 74. The first connection tube 78 may connect an uppermost turn of the inner spiral pipe portion 74 with an uppermost turn of the outer spiral pipe portion 77. The inner spiral pipe portion 74, the first connection tube 78, and the outer spiral pipe portion 77 may constitute a first path P1 through which the second fluid may pass. The second fluid may pass through the first connection tube 78 after passing first through the inner spiral pipe portion 74, and then may pass through the outer spiral pipe portion 77, and may pass through the first connection pipe 78 after passing first through the outer spiral pipe portion 77, and then may pass through the inner spiral pipe portion 74.

The plurality of spiral pipe portions 74, 75, 76, and 77 may include a plurality of intermediate spiral pipe portions 75 and 76, which may be farther from the central axis VX than the inner spiral pipe portion 74 and closer to the central axis VX than the outer spiral pipe portion 77. The intermediate spiral pipe portions 75 and 76 may be connected by a second connection tube 79. The intermediate spiral pipe portions 75 and 76 may include two spiral pipe portions, three spiral pipe portions, or four or more spiral pipe portions. Hereafter, it is described that the intermediate spiral pipe portions 75 and 76 include two spiral pipe portions 75 and 76. Any one of the intermediate spiral pipe portions 75 and 76, the second connection tube 79, and the other of the intermediate spiral pipe portions 75 and 76 may be connected in series, such that the second fluid may sequentially pass through them. The second connection tube 79 may connect uppermost turns of the intermediate spiral pipe portions 75 and 76. Any one of the intermediate spiral pipe portions 75 and 76, the second connection tube 79, and the other of the intermediate spiral pipe portions 75 and 76 may constitute a second path P2, through which the second fluid may pass. The second fluid may sequentially pass through any one of the intermediate spiral pipe portions 75 and 76, the second connection tube 79, and the other of the intermediate spiral pipe portions 75 and 76. The second fluid may pass through the second connection tube 79 after passing first through any one of the intermediate spiral pipe portions 75 and 76, and then may pass through the other of the intermediate spiral pipe portions 75 and 76, or may pass through the second connection tube 79 after passing first through the other of the intermediate spiral pipe portions 75 and 76, and then may pass through any one of the intermediate spiral pipe portions 75 and 76.

A sum of lengths of a flow path of the inner spiral pipe portion 74, a flow path of the first connection pipe 78, and a flow path of the outer spiral pipe portion 77 may be approximately 0.8 to 1.2 times a sum of lengths of a flow path of any one of the intermediate spiral pipe portions 75 and 76, a flow path of the second connection tube 79, and a flow path of the other one of the intermediate spiral pipe portions 75 and 76. That is, a length of the first path P1 may be approximately 0.8 to 1.2 times a length of the second path P2, and the second fluid may be uniformly distributed without concentrating in any one of the first path P1 and the second path P2. In the first path P1 and the second path P2, the plurality of spiral pipe portions 74, 75, 76, and 77 may ensure generally uniform heat transfer performance.

The second fluid may sequentially pass through the plurality of inner spiral pipe portion 74, the first connection tube 78, and the outer spiral pipe portion 77. The compressor outlet channel 3 shown in FIG. 1 may be connected with the straight pipe portion 81 extending from the inner spiral pipe portion 74, and the expansion device connection channel 5 shown in FIG. 1 may be connected with the straight pipe portion 84 extending from the outer spiral pipe portion 77.

The second fluid may sequentially pass through the intermediate spiral pipe portion 75 (hereafter, referred to as "intermediate small spiral pipe portion") which is closer to the central axis of the intermediate spiral pipe portions 75 and 76, the second connection pipe 79, and the intermediate spiral pipe portion 76 (hereafter, referred to as "intermediate large spiral pipe portion"), which is farther from the central axis of the intermediate spiral pipe portions 75 and 76. The compressor outlet channel 3 shown in FIG. 1 may be connected with the straight pipe portion 82 extending from the intermediate small spiral pipe portion 75, and the expansion device connection channel 5 shown in FIG. 1 may be connected with the straight pipe portion 83 extending from the intermediate large spiral pipe portion 76.

The compressor outlet channel 3 shown in FIG. 1 may be divided into branches, of which any one branch channel may be connected with the straight pipe portion 81 extending from the inner spiral pipe portion 74 and the other branch channel may be connected with the straight pipe portion 82 extending from the intermediate small spiral pipe portion 75.

The expansion device connection channel 5 shown in FIG. 1 may have two meeting channels, of which one meeting channel may be connected with the straight pipe portion 84 extending from the outer spiral pipe portion 77 and the other meeting channel may be connected with the straight pipe portion 83 extending from the intermediate large spiral pipe portion 76.

Figure 7:
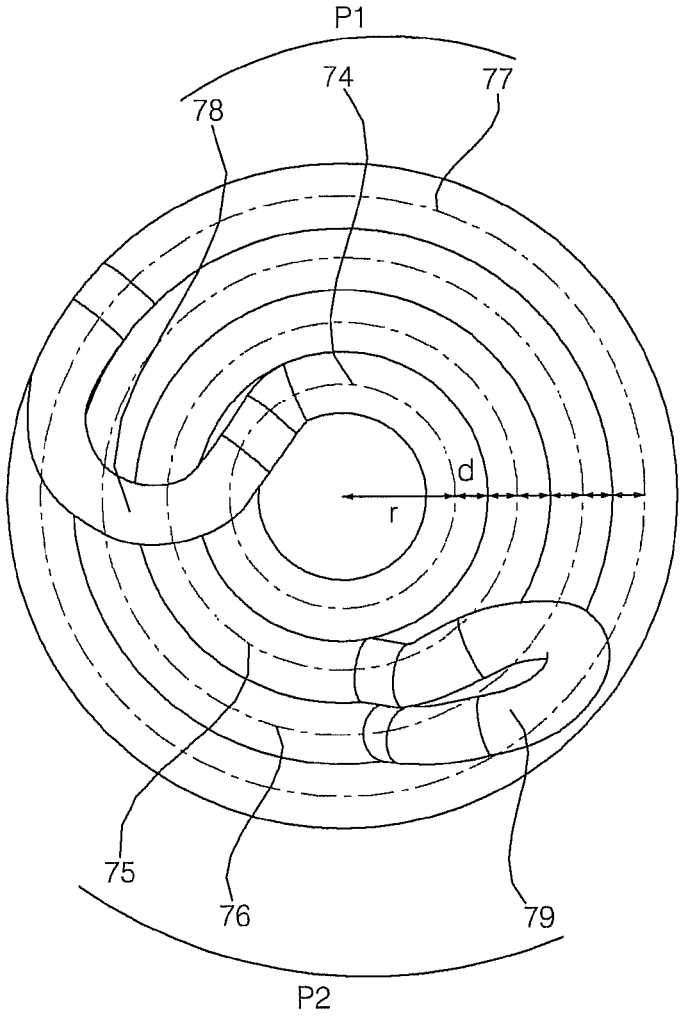
FIG. 7 is a plan view enlarging and showing a plurality of spiral pipe portions of a heat exchanger according to an embodiment.
Figure 9:
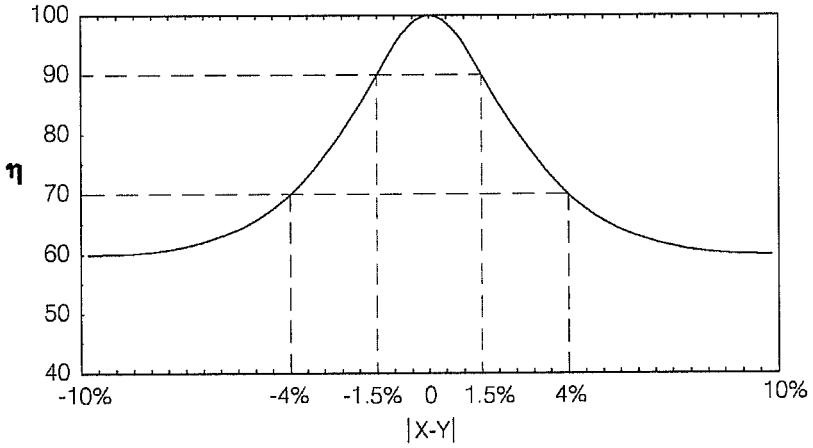
FIG. 9 is a graph showing heat transfer performance according to a difference in length of a flow path of a heat exchanger according to an embodiment.

FIG. 7 is a plan view enlarging and showing a plurality of spiral pipe portions of a heat exchanger according to an embodiment, and FIG. 9 is a graph showing heat transfer performance according to a difference in length of a flow path of a heat exchanger according to an embodiment.

The heat exchanger 4 may be a 4-row and 2-path heat exchanger having four spiral pipe portions 74, 75, 76, and 77 and two paths P1 and P2. When lengths of the first path P1 and the second path P2 are the same, the second fluid may be equally distributed to the first path P1 and the second path, thus an optimum heat transfer amount may be achieved.

The spiral pipe portions 74, 75, 76, and 77 may be in contact with other spiral pipe portions in a direction extending perpendicular to the central axis VX. Assuming that a number of turns (number of rows: a number of turns in a height direction of the spiral pipe portion) of each of the spiral pipe portions 74, 75, 76, and 77 is P, a distance between the central axis VX and a center line of the inner spiral pipe portion 74 is r, a turn radius of each of the plurality of spiral pipe portions 74, 75, 76, and 77 is d, and turns are circular in shape, a flow path length of the inner spiral pipe portion 74 may be $2\pi r \times P$, a flow path length of the small intermediate spiral pipe portion 75 may be $2\pi(r+2d) \times P$, a flow path length of the large intermediate spiral pipe portion 76 may be $2\pi(r+4d) \times P$, and a flow path length of the outer spiral pipe portion 77 may be $2\pi(r+6d) \times P$.

A length of the first path P1 may be a sum of the flow path length of the first connection tube 78, $2\pi r \times P$, and $2\pi(r+6d) \times P$, and a length of the second path P2 may be a sum of the flow path length of the second connection tube 79, $2\pi(r+2d) \times P$, and $2\pi(r+4d) \times P$. The length obtained by subtracting the flow path length of the first connection pipe 78 from the length of the first path P1 may be $2\pi(2r+6d) \times P$ and the length obtained by subtracting the flow path length of the second connection pipe 79 from the length of the second path P2 may be $2\pi(2r+6d) \times P$.

In the heat exchanger 4, the lengths of the paths P1 and P2 may be the same, and the spiral pipe portions 74, 75, 76, and 77 having the same path length may be combined, even if the number of the spiral pipe portions 74, 75, 76. and 77, that is, the number of rows increases.

When two spiral pipe portions are connected by one tube in the heat exchanger 4 and the number of paths of the heat exchanger 4 is n, the number of (rows of) the spiral pipe portions 74, 75, 76. and 77 may be 2n and the sum of the lengths of the other spiral pipe portions, except for the length of the connection tubes, in the lengths of the paths P1 and P2 may be $2\pi(2r \div (4n-2)d) \times P$. That is, the sum X of the flow path length of the inner spiral pipe portion 74 and the flow path length of the outer spiral pipe portion 77 may be $2\pi(2r+(4n-2)d) \times P$ and the sum Y of the intermediate spiral pipe portions 75 and 76 may be $2\pi(2r+(4n-2)d) \times P$.

As the spiral pipe portions 74, 75, 76, and 77 are spirally wound in the heat exchanger 4, a difference between the path lengths may be generated, as the number of turns increases, and the sum X of the flow path length of the inner spiral pipe portion 74 and the flow path length of the outer spiral pipe portion 77 and the sum Y of the intermediate spiral pipe portions 75 and 76 may have a flow path difference $|X-Y|$ that makes it possible to ensure appropriate heat transfer performance.

Figure 8:
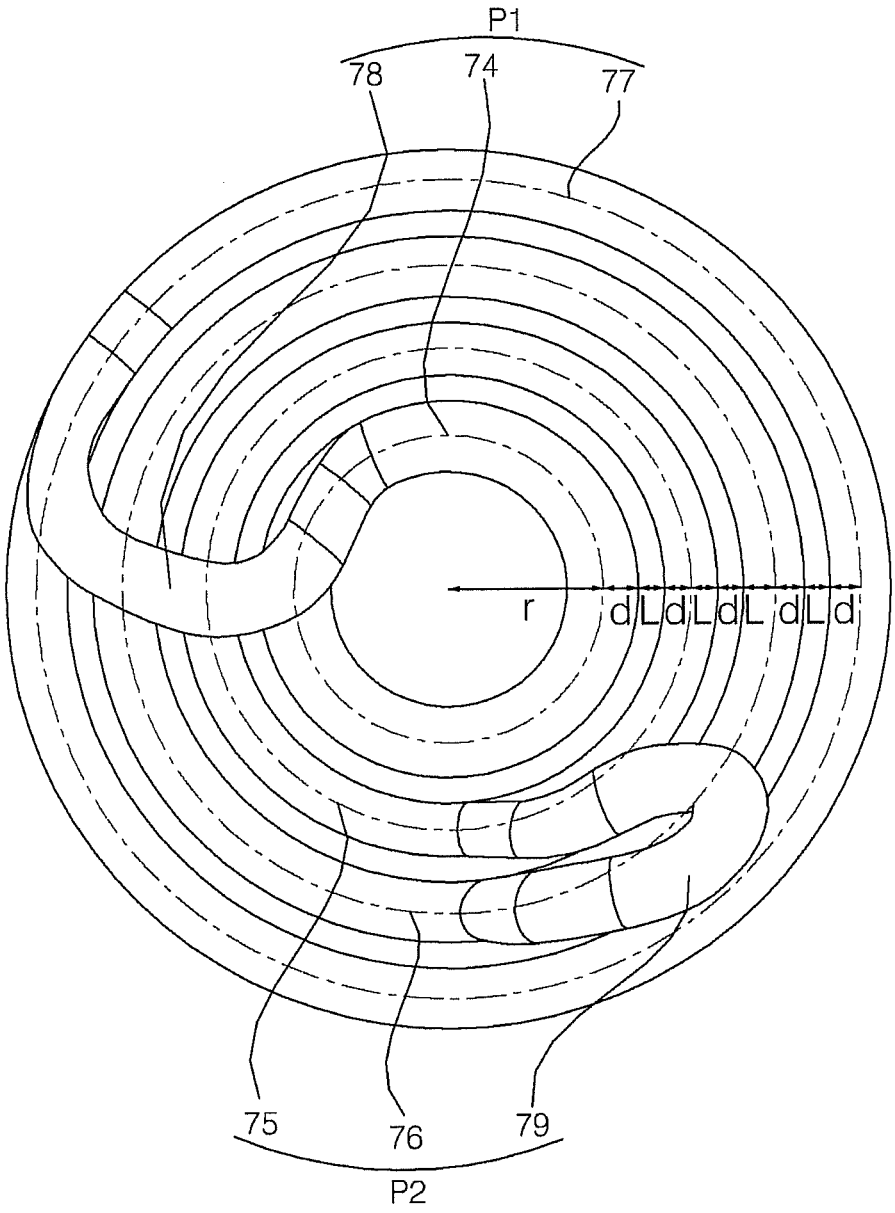
FIG. 8 is a plan view enlarging and showing a plurality of spiral pipe portions of a heat exchanger according to another embodiment.

In the heat exchanger 4, water, which may function as cooling water, may be used as the first fluid, and one of various refrigerants, such as a Freon-based refrigerant or a carbon dioxide refrigerant, which is generally used in air conditioners, may be used as the second fluid. The heat transfer performance of the cooling water and the refrigerant may be measured in accordance with the flow path difference $|X-Y|$, under conditions that a speed of a current of water in the first pipe 30 is approximately 2.7 m/sec, a mass flow rate of the water is approximately 1.6 kg/sec, and a volume flow rate of the water is approximately 96 LPM. In this case, the flow path difference $|X-Y|$ may satisfy approximately 70% or more of an optimum performance, as shown in FIG. 8, when being approximately ±4% of the sum X of the flow path length of the inner spiral pipe portion 74 and the flow path length of the outer spiral pipe portion 77. Further, the flow path difference $|X-Y|$ may satisfy approximately 70% or more of an optimum performance, when being approximately ±4% of the sum Y of the flow path lengths of the intermediate spiral pipes 75 and 76. For example, assuming that one of the sum X of the flow path length of the inner spiral pipe portion 74 and the flow path length of the outer spiral pipe portion 77 and the sum Y of the flow path lengths of the intermediate spiral pipes 75 and 76 is approximately 16000 mm, the flow path difference $|X-Y|$ may be designed to be within approximately 640 mm, not over approximately 640 mm.

Meanwhile, the flow path difference $|X-Y|$ may satisfy approximately 90% or more of an optimum performance, as shown in FIG. 8, when being approximately ±1.5% of the sum X of the flow path length of the inner spiral pipe portion 74 and the flow path length of the outer spiral pipe portion 77, and the flow path difference $|X-Y|$ may be approximately ±1.5% of the sum X of the flow path length of the inner spiral pipe portion 74 and the flow path length of the outer spiral pipe portion 77. Further, the flow path difference $|X-Y|$ may satisfy approximately 90% or more of an optimum performance, when being approximately ±1.5% of the sum Y of the flow path lengths of the intermediate spiral pipes 75 and 76, and the flow path difference $|X-Y|$ may be approximately ±1.5% of the sum Y of the flow path lengths of the intermediate spiral pipes 75 and 76. For example, when one of the sum X of the flow path length of the inner spiral pipe portion 74 and the flow path length of the outer spiral pipe portion 77 and the sum Y of the flow path lengths of the intermediate spiral pipes 75 and 76 is approximately 16000 mm, the flow path difference $|X-Y|$ may be designed not over approximately 240 mm and within approximately 240 mm.

FIG. 8 is a plan view enlarging and showing a plurality of spiral pipe portions of a heat exchanger according to another embodiment.

The plurality of spiral pipe portions 74, 75, 76, and 77 may be spaced from other spiral pipe portions in a direction perpendicular to the central axis VX, in the heat exchanger 4 according to this embodiment. The plurality of spiral pipe portions 74, 75, 76, and 77 may be spaced with regular intervals L. Assuming that a number of turns (number of rows) of each of the plurality of spiral pipe portions 74, 75, 76, and 77 is P, a distance between the central axis VX and a center line of the inner spiral pipe portion 74 is r, a turn radius of each of the spiral pipe portions 74, 75, 76, and 77 is d, gaps among the spiral pipe portions 74, 75, 76, and 77 are L, and turns are circular shapes, a flow path length of the inner spiral pipe portion 74 may be $2\pi r \times P$, a flow path length of the intermediate small spiral pipe portion 75 may be $2\pi(r+2d+L) \times P$, a flow path length of the intermediate large spiral pipe portion 76 may be $2\pi(r+4d+2L) \times P$, and a flow path length of the outer spiral pipe portion 77 may be $2\pi(r+6d+3L) \times P$.

A length of the first path P1 may be a sum of the flow path length of the first connection tube 78, $2\pi r \times P$, and $2\pi(r+6d+3L) \times P$, and a length of the second path P2 may be a sum of the flow path length of the second connection tube 79, $2\pi(r+2d+L) \times P$, and $2\pi(r+4d+2) \times P$.

A length X obtained by subtracting the flow path length of the first connection pipe 78 from the length of the first path P1 may be $2\pi(2r+6d+3L) \times P$ and a length Y obtained by subtracting the flow path length of the second connection pipe 79 from the length of the second path P2 may be $2\pi(2r+6d+3L) \times P$.

In the heat exchanger 4, the lengths of the paths P1 and P2 may be made the same, and the spiral pipe portions 74, 75, 76. and 77 having the same path length may be combined, even if the number of the spiral pipe portions 74, 75, 76. and 77, that is, the number of rows increases.

Further, when two spiral pipe portions are connected by one tube and the number of paths of the heat exchanger 4 is n, a number of rows of the spiral pipe portions 74, 75, 76, and 77 may be 2n and a sum of lengths of the other spiral pipe portions, except for the flow path length of the connection tubes, in the lengths of the paths P1 and P2 may be $2\pi(2r+(4n-2)d+(2n-1)L)\times P$.

A sum X of the flow path length of the inner spiral pipe portion 74 and the flow path length of the outer spiral pipe portion 77 and the sum Y of the flow path lengths of the intermediate spiral pipes 75 and 76 may be determined by the following Formula 1.

$$X=Y=2\pi(2r+(4n-2)d+(2n-1)L)\times P\times Q \quad \text{[Formula 1]}$$

In Formula 1, when L is 0, the spiral pipe portions may be in sequential contact with other spiral pipe portions in the direction perpendicular to the central axis VX.

Further, the flow path difference |X−Y|, which is the difference between X and Y, may be within approximately ±4% of X and Y, and Q may be a constant value between approximately 0.96 and 1.14.

Further, the flow path difference |X−Y|, which is the difference between X and Y, may be within approximately ±1.5% of X and Y, and Q may be a constant value between approximately 0.985 and 1.015.

Related art heat exchangers have a problem in that the structure is complicated because a plurality of coils wound clockwise or counterclockwise from an outermost coil winding to an innermost coil winding of a spiral coil is vertically spaced, and the spiral coils are connected with an intake manifold and an exhaust manifold vertically disposed in a shell.

Embodiments disclosed herein provide a heat exchanger that may include a shell; a first pipe that guides a first fluid into the shell; a plurality of spiral pipe portions, through which a second fluid that exchanges heat with the first fluid may pass, and having different distances from a central axis; and a second pipe that guides the first fluid to the outside of the shell, in which an inner spiral pipe portion, which is closet to the central axis, and an outer spiral pipe portion, which is farthest from the central axis in the spiral pipe portions are connected by a first connection tube, and a plurality of intermediate spiral pipes, which is farther from the central axis than the inner spiral pipe portion and closer to the central axis than the outer spiral pipe portion, is connected by a second connection tube.

The spiral pipe portions may have a plurality of turns that is spirally wound with a same distance from the central axis. The central axis may be vertical and the spiral pipe portions may have different distances in a direction perpendicular to the central axis. The central axis may coincide with a central axis of the second pipe.

The first connection pipe may connect uppermost turns of the inner spiral pipe portion with uppermost turns of the outer spiral pipe portion, and the second connection tube may connect uppermost turns of the intermediate spiral pipe portions. The spiral pipe portions may be positioned between the second pipe and the shell. The inner spiral pipe portion may be in contact with the second pipe. The inner spiral pipe portion may be fixed to the second pipe. The outer spiral pipe portion may be spaced from an inner wall of the shell.

An exit end, through which the first fluid may come out of the first pipe, may be positioned under at least one of the spiral pipe portions. A straight pipe portion, which may pass through the shell, may extend in each of the spiral pipe portions. The straight pipe portion may extend from a lowermost turn of the spiral pipe portion. The straight pipe portion may extend in parallel with the central axis.

A sum of lengths of a flow path of the inner spiral pipe portion, a flow path of the first connection tube, and a flow path of the outer spiral pipe portion may be approximately 0.8 to 1.2 times a sum of lengths of the flow path of any one of the intermediate spiral pipe portions, the flow path of the second connection tube, and another one of the intermediate spiral pipe portions.

The shell may include a case that is vertically disposed or extend vertically; a top cover that is coupled to the top of the case; and a lower cover that is coupled to the bottom of the case. The first fluid may sequentially pass through the inner spiral pipe portion and the first connection tube. The first fluid may sequentially pass through an intermediate spiral pipe portion closer to the central axis in the intermediate spiral pipe portions, a second connection tube, and an intermediate spiral pipe portion farther from the central axis in the intermediate spiral pipe portions.

The sum of the lengths of the flow path of the inner spiral pipe portion, the flow path of the first connection tube, and the flow path of the outer spiral pipe portion may be approximately 0.8 to 1.2 times the sum of the lengths of the flow path of any one of the intermediate spiral pipe portions, the flow path of the second connection tube, and another one of the intermediate spiral pipe portions.

A difference between the sum of the flow path length of the inner spiral pipe portion and the flow path length of the outer spiral pipe portion and the sum of the intermediate spiral pipe portions may be within approximately ±4% of each of the sum of the flow path length of the inner spiral pipe portion and the flow path length of the outer spiral pipe portion and the sum of the intermediate spiral pipe portions. The difference between the sum of the flow path length of the inner spiral pipe portion and the flow path length of the outer spiral pipe portion and the sum of the intermediate spiral pipe portions may be within approximately ±1.5% of each of the sum of the flow path length of the inner spiral pipe portion and the flow path length of the outer spiral pipe portion and the sum of the intermediate spiral pipe portions.

The sum of the flow path length of the inner spiral pipe portion and the outer spiral pipe portion and the sum of the flow path lengths of the intermediate spiral pipe portion may be determined by $2\pi(2r+(4n-2)d+(2n-1)L)\times P\times Q$, where r may be the distance between the central axis and the center line of the inner spiral pipe portion, n may be the number of paths of the heat exchanger, d may be the turn radius of the spiral pipe portions, L may be the gap between the spiral pipe portions, P may be the number of lines of the spiral pipe portions, and Q may be one value between approximately 0.96 and 1.14.L may be 0.Q may be one value between approximately 0.985 and 1.015.

Embodiments disclosed herein have an advantage that it may be possible to connect a plurality of spiral pipe portions while minimizing a number of connection tubes, and to minimize joints of the spiral pipe portions and the connection tubes, so that the structure is simple and manufacturing is easy.

Further, embodiments disclosed herein have an advantage that it may be possible to minimize a reduction in performance, which may be generated when a difference in length of a plurality of paths is large, by minimizing a difference in length of the paths formed by the spiral pipe portions and the connection tubes.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A heat exchanger, comprising:

a shell;

a first pipe that guides a first fluid into the shell;

a plurality of spiral pipe portions, through which a second fluid, which exchanges heat with the first fluid, passes, the plurality of spiral pipe portions having different distances from a central longitudinal axis; and a second pipe that guides the first fluid outside of the shell, wherein an inner spiral pipe portion of the plurality of pipe portions, which is closest to the central longitudinal axis of the plurality of spiral pipe portions, and an outer spiral pipe portion of the plurality of spiral pipe portions, which is farthest from the central longitudinal axis, are connected by a first connection tube, wherein a plurality of intermediate spiral pipe portions of the plurality of spiral pipe portions, which is farther from the central longitudinal axis than the inner spiral pipe portion and closer to the central longitudinal axis than the outer spiral pipe portion, is connected by a second connection tube, and wherein the inner spiral pipe portion is fixed to the second pipe.

2. The heat exchanger of claim 1, wherein each of the plurality of spiral pipe portions includes a plurality of turns spirally wound with a same distance from the central longitudinal axis.

3. The heat exchanger of claim 1, wherein the central longitudinal axis extends in a substantially vertical direction, and wherein the plurality of spiral pipe portions has different distances in a direction that extends substantially perpendicular to the central longitudinal axis.

4. The heat exchanger of claim 1, wherein the central longitudinal axis of the plurality of spiral pipe portions coincides with a central longitudinal axis of the second pipe.

5. The heat exchanger of claim 1, wherein the first connection tube connects an uppermost turn of the inner spiral pipe portion with an uppermost turn of the outer spiral pipe portion, and wherein the second connection tube connects uppermost turns of the plurality of intermediate spiral pipe portions.

6. The heat exchanger of claim 1, wherein the plurality of spiral pipe portions is positioned between the second pipe and the shell.

7. The heat exchanger of claim 1, wherein the inner spiral pipe portion is in contact with the second pipe.

8. The heat exchanger of claim 1, wherein the outer spiral pipe portion is spaced from an inner wall of the shell.

9. The heat exchanger of claim 1, wherein an exit end, through which the first fluid comes out of the first pipe, is positioned under at least one of the plurality of spiral pipe portions.

10. The heat exchanger of claim 1, wherein each of the plurality of spiral pipe portions includes a straight pipe portion that passes through the shell.

11. The heat exchanger of claim 10, wherein the straight pipe portion extends from a lowermost turn of the plurality of spiral pipe portions.

12. The heat exchanger of claim 10, wherein the straight pipe portion extends substantially parallel to the central longitudinal axis.

13. The heat exchanger of claim 10, wherein the shell includes:

a case that is vertically disposed;

a top cover coupled to a top of the case; and a lower cover coupled to a bottom of the case.

14. The heat exchanger of claim 1, wherein the second fluid sequentially passes through the inner spiral pipe portion and the first connection tube.

15. The heat exchanger of claim 14, wherein the second fluid sequentially passes through an intermediate spiral pipe portion of the plurality of intermediate spiral pipe portions closer to the central longitudinal axis, the second connection tube, and an intermediate spiral pipe portion of the plurality of intermediate spiral pipe portions farther from the central longitudinal axis.

16. The heat exchanger of claim 1, wherein a sum of lengths of a flow path of the inner spiral pipe portion, a flow path of the first connection tube, and a flow path of the outer spiral pipe portion is approximately 0.8 to 1.2 times a sum of lengths of a flow path of any one of the plurality of intermediate spiral pipe portions, a flow path of the second connection tube, and a flow path of the another one of the plurality of intermediate spiral pipe portions.

17. The heat exchanger of claim 1, wherein a difference $|X-Y|$ between a sum X of a flow path length of the inner spiral pipe portion and a flow path length of the outer spiral pipe portion and a sum Y of flow path lengths of the plurality of intermediate spiral pipe portions is within approximately ±4% of each of the sum X of the flow path length of the inner spiral pipe portion and the flow path length of the outer spiral pipe portion and the sum Y of the flow path lengths of the plurality of intermediate spiral pipe portions.

18. The heat exchanger of claim 1, wherein a difference $|X-Y|$ between a sum X of a flow path length of the inner spiral pipe portion and a flow path length of the outer spiral pipe portion and a sum Y of flow path lengths of the plurality of intermediate spiral pipe portions is within approximately ±1.5% of each of the sum X of the flow path length of the inner spiral pipe portion and the flow path length of the outer spiral pipe portion and the sum Y of the flow path lengths of the plurality of intermediate spiral pipe portions.

19. The heat exchanger of claim 1, wherein a sum X of a flow path length of the inner spiral pipe portion and a flow path length of the outer spiral pipe portion and a sum Y of flow path lengths of the plurality of intermediate spiral pipe portions are determined by $2\pi(2r+(4n-2)d+(2n-1)L)\times P\times Q$, where r is a distance between the central longitudinal axis and a center line of the inner spiral pipe portion, n is a number of paths of the heat exchanger, d is a turn radius of the plurality of spiral pipe portions, L is a gap between the plurality of spiral pipe portions, P is a number of lines of the plurality of spiral pipe portions, and Q is a value between approximately 0.96 and 1.14.

20. The heat exchanger of claim 19, wherein L is approximately 0.

21. The heat exchanger of claim 19, wherein Q is a value between approximately 0.985 and 1.015.

22. An air conditioner including the heat exchanger of claim 1.

* * * * *